United States Patent [19]

Sian et al.

[11] Patent Number: 4,826,452

[45] Date of Patent: May 2, 1989

[54] TWO-PART ELECTRICAL CONNECTOR

[75] Inventors: Sucha S. Sian, Southfield, Mich.; Paul H. Marcus, Elsdorf, Fed. Rep. of Germany; Felix P. Adler, Mt. Clemens, Mich.

[73] Assignee: Altair International, Inc., Mt. Clemens, Mich.

[21] Appl. No.: 109,451

[22] Filed: Oct. 16, 1987

[51] Int. Cl.[4] ..... H01R 13/40

[52] U.S. Cl. ..... 439/595

[58] Field of Search ..... 439/592–595, 439/597–599, 281, 282

[56] References Cited

U.S. PATENT DOCUMENTS 3,686,619 8/1972 McCardell, Jr. et al. ..... 439/595
4,557,542 12/1985 Coller et al. ..... 439/595
4,714,437 12/1987 Dyki ..... 439/595
4,776,813 10/1988 Wilson et al. ..... 439/595

*Primary Examiner*—P. Austin Bradley
*Attorney, Agent, or Firm*—Weingarten, Schurgin, Gagnebin & Hayes

[57] ABSTRACT

A two-part electrical connector, each part having an associated locking member. Locking members engage respective connector parts in a two-step, press-fit relationship. First step engagement secures the locking members to the respective connector parts in loose engagement. Second step engagement locks a plurality of wires or cables and the locking member tightly into the connector parts. Thereafter, the two connector parts are latched together in releasable contact and a good electrical connection is achieved.

15 Claims, 3 Drawing Sheets

TWO-PART ELECTRICAL CONNECTOR

FIELD OF THE INVENTION

The present invention relates to electrical connectors and in particular to a two part releaseably engageable electrical connector each part having two elements adapted to engage each other in two-step press-fit engagement.

BACKGROUND OF THE INVENTION

Reliable inexpensive electrical connectors are required in a wide variety of applications. Where such connectors are used in mass manufacturing operations, it is particularly important that a minimum amount of assembly of the connectors is performed at the place where the connectors are used. Therefore, any reduction in the number of steps required to finally assemble the connectors and perform the connection is highly advantageous. The present invention requires minimal assembly at the user's facility. Instead, the user simply inserts wires or cables into male and female housings, respective locking caps are pushed into place and the connection can then be performed.

SUMMARY OF THE INVENTION

The connector of this invention is assembled from a male and female housing each having an associated locking member. Locking members are secured to the respective housings in two-step press fit engagement utilizing tabs on the locking member which cooperate with grooves within the housings.

When the locking members are pushed into first-step engagement with their respective housings they are loosely attached to the housings. The connector parts would typically be shipped at this stage of assembly.

Second-step engagement is performed after wires or cables have been inserted into the housings. At this point the locking members are then pushed into second-step engagement with the respective housings which causes locking mechanisms within each housing to engage collars located proximate to the inserted ends of the wires or cables. Retraction of the wires or cables from the housings is thereby prevented. The male and female housings are then mated in releasable sliding engagement and a good electrical connection is achieved. Seals may be placed on the wires or cables and on the housing locking mechanism to ensure a watertight or moisture resistance connection.

DESCRIPTION OF THE DRAWINGS

The invention will be more fully understood from the following detailed description taken in conjunction with the accompanying drawings in which.

DETAILED DESCRIPTION OF THE INVENTION

Figure 1:
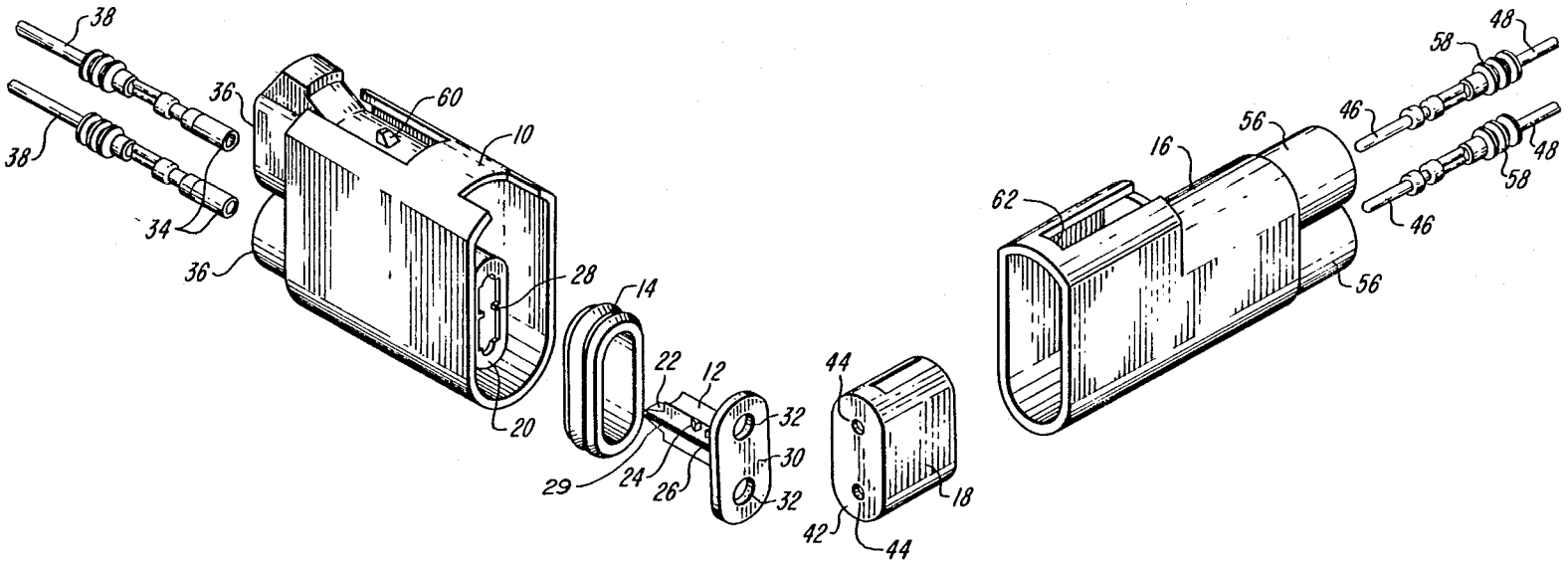
FIG. 1 illustrates the components of the present invention before assembly.

Referring now to FIG. 1, a female housing 10, a female activating member 12, and a seal 14 are shown. In addition, a male housing 16 and a male activating member 18 are illustrated. Both male and female housings 10, 16 and activating members 12, 18 are constructed of an electrically non-conductive material, typically a plastic material. A female receiving member 20 integrally formed within the female housing 10 receives the wedged spine 22 of the female activating member 12. First and second pairs of opposing tabs 24 and 26 protruding from the female activating member 12 coact with a groove located within the female receiving member 20. Keyways 29 are also provided for cooperation with keys 28 on member 20. The seal 14 is peripherally mounted on the female receiving member 20. The face 30 of the female activating member 12 has a plurality of holes 32 therethrough in predetermined pattern to hold in spaced relationship a plurality of electrical sockets 34. Tubular conduits 36 maintain a spaced relationship of the electrical sockets 34 and associated wires 38 within the female housing 10. The face 42 of the male activating member 18 has holes 44 therethrough in predetermined pattern to maintain a plurality of male electrical terminals 46 in spaced relationship. The predetermined pattern of the male activating member holes 44 corresponds to the predetermined pattern of the female activating member holes 32 permitting the male electrical terminals 46, when the female activating member 12 and male activating member 18 are in opposed contact, to protrude through the male activating member holes 44 and engage the electrical sockets 34 to ensure a good electrical connection.

Figure 2A:
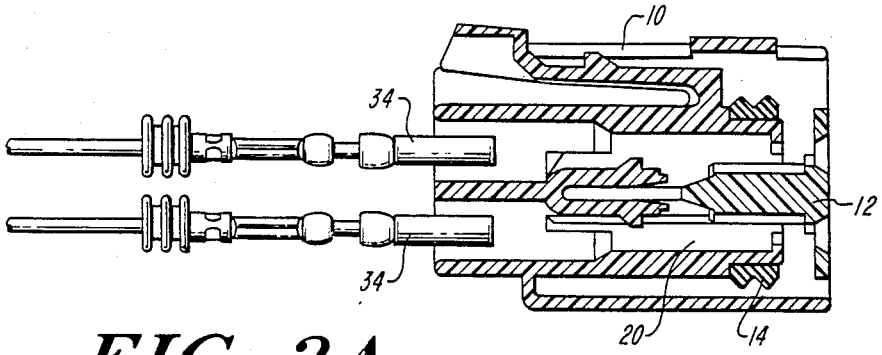
FIGS. 2A and 2B are cross sections of the components of the present invention in first-step engagement.
Figure 2B:
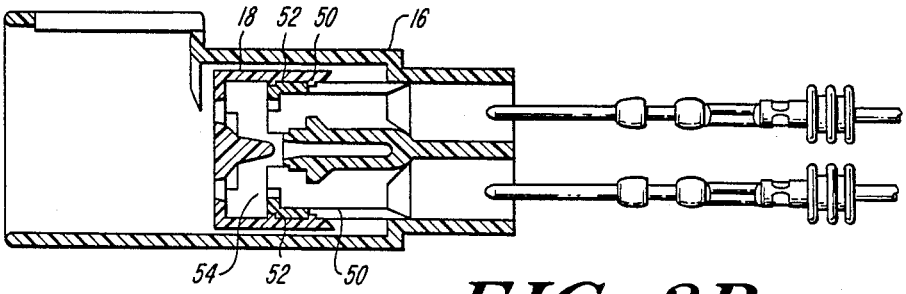

Referring now to FIG. 2A, the female housing 10 is illustrated with the female activating member 12 in first-step engagement. At this stage, the first pair of opposing tabs 24, as shown in FIG. 1, of the female activating member 12 cooperates with a groove located within the female receiving member 20 to prevent separation of the female activating member 12 from the female housing 10. The seal 14 is shown peripherally mounted on the female receiving member 20 of the female housing 10. In first-step engagement of the male activating member 18 with the male housing 16, a first pair of clasping tabs 50 secure the male activating member 18 in frictional engagement with shoulders 52 of a male receiving member 54 integrally formed with the male housing 16. Tubular conduits 56 ensure that a plurality of male connecting ends 46 and the second plurality of wires 48 are maintained in separated spaced relationship within the male housing 16. Seals 58 on the second plurality of wires 48 prevent moisture entering the male housing tubular conduits 56. A latch 60 on the female housing 10 cooperates with a latching shoulder 62 on the male housing 16 to hold the male and female housings 16 and 10 in releasable sliding engagement. The upper corners of the housing 16 are relatively sharp to serve as polarized keys cooperative with the matable corners of housing 10.

Figure 3:
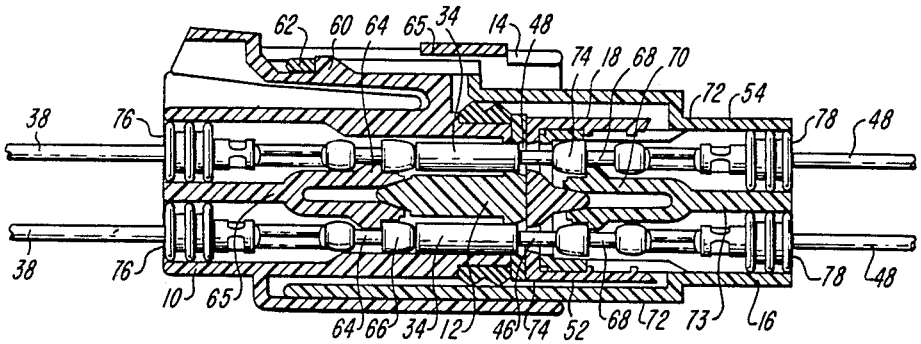
FIG. 3 is a cross section of the present invention in second-step engagement.
Figure 4A:
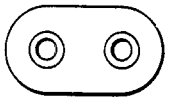
FIGS. 4A–4E illustrate alternative embodiments of the present invention.
Figure 4B:
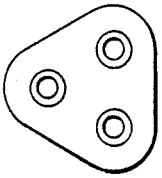
Figure 4C:
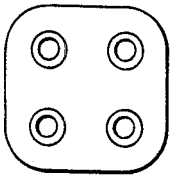
Figure 4D:
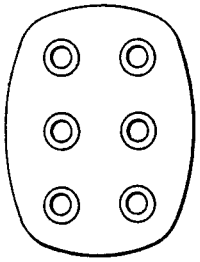
Figure 4E:
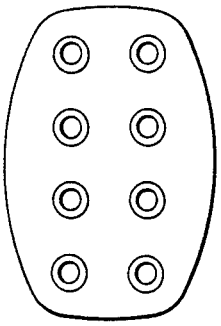

Referring now to FIG. 3, the female housing 10 and male housing 16 are shown in releasable sliding engagement. At this stage the latch 60 abuts the male housing shoulder 62 to prevent separation of the male and female housings 16 and 10. The female activating member 12 is shown in second step engagement with the female housing 10. The plurality of electrical sockets 34 has been fully inserted into the female housing 10. Second-step engagement of the female activating member 12 into the female housing 10 activates the prongs 64 of the female locking member 65 into frictional engagement with collars 66 adjacent to the electrical sockets 34.

Thus, extraction of the plurality of electrical sockets 34 from the female housing 10 is prevented. The male activating member 18 is shown in second-step engagement with the male housing 16. In second-step engagement of the male activating member, a second pair of clasping tabs 68 on the male activating member 18 is in frictional engagement with the shoulder 52 of the male receiving member 54 and the wedged spine 70 of the male activating member 18 activates prongs 72 of the male locking member 73. The prongs 72 engage collars 74 adjacent to the male electrical terminals 46. Thus, extraction of the male electrical terminals 46 from the male housing 16 is prevented. The male electrical terminals 46 are shown protruding through the holes 44 of the male activating member 18 and in engagement with the electrical sockets 34. Seals 76 and 78 on the first and second pluralities of wires, 38 and 48, cooperate with the seal 14 to prevent moisture entering the engaged male and female housings 16, 10. A dry electrical connection is thereby achieved.

Referring now to FIGS. 4A–4E, a variety of activating member face hole configurations is illustrated. These activating members may be utilized to facilitate the connection of differing quantities of wires. The structure of the male housing and female housing would be altered accordingly to accommodate the required number of wires. For example, referring now to FIG. 4C, if four connections are desired, both male activating member face and female activating member face would have four holes in predetermined corresponding pattern. In addition, both male housing and female housing would have four tubular conduits. Other appropriate alterations to the structure of these embodiments would, of course, also be necessary.

Accordingly, the invention is not to be limited by what has been particularly shown and described, except as indicated in the appended claims.

What is claimed is:

1. A two-part electrical connector for electrically connecting a plurality of collared electrical sockets to a plurality of collared male electrical terminals comprising:

a female housing having a first end and second end;

means for disposing the plurality of electrical sockets within said female housing comprising female housing locking means and female housing activating means for locking said female housing locking means into engagement with the plurality of electrical sockets, said female housing activating means comprising first means for engaging said female housing activating means in a first position in said female housing, and second means for engaging said female housing activating means in a second position in said female housing in which said female housing activating means is engaged with said female housing locking means;

a male housing having a first end and a second end; and means for disposing the plurality of male electrical terminals within said male housing comprising male housing locking means and male housing activating means for locking said male housing locking means into engagement with the plurality of electrical terminals, said male housing activating means comprising first means for engaging said male housing activating means in a first position in said male housing, and second means for engaging said male housing activating means in a second position in said male housing in which said male housing activating means is engaged with said male housing locking means.

2. The electrical connector of claim 1 wherein the first end of said female housing is of sufficient dimension to receive in snug sliding releasable engagement the first end of said male housing, and wherein said male housing is of sufficient dimension for snug sliding releasable engagement with said first end of said female housing.

3. The electrical connector of claim 1 wherein said female housing further comprises a latch integrally formed therewith and wherein said male housing further comprises a latching shoulder adjacent to the first end of said male housing for engaging the latch of said female housing to hold said female housing and said male housing in releasable sliding engagement.

4. The electrical connector of claim 1 wherein said female housing further comprises a plurality of integrally formed tubular conduits at the second end of said female housing for maintaining in spaced relationship within said female housing the plurality of collared electrical sockets, and wherein said male housing further comprises a plurality of integrally formed tubular conduits at the second end of said male housing for maintaining in spaced relationship within said male housing the plurality of collared male electrical terminals.

5. The electrical connector of claim 1, wherein:

said female housing locking means comprises at least one pronged locking member integrally formed within said female housing, each prong having a tab protruding therefrom to engage the collars of the plurality of electrical sockets;

said male housing locking means comprises at least one pronged locking member integrally formed within said male housing, each prong having a tab protruding therefrom to engage the collars of the plurality of male electrical terminals.

6. The electrical connector of claim 5 wherein:

said female housing activating means comprises an activating member having a face circumscribing at least one hole, a spine having a widge-shaped protrusion extending from one side of said face for engaging and activating said female housing locking means, and wherein said male housing activating means comprises an activating member having a face circumscribing at least one hole, a wedge-shaped spine extending from said face for engaging and activating said male housing locking means, and at least one side upstanding from said face.

7. The electrical connector of claim 6 wherein said female housing activating means further comprises a receiving member integrally formed with said female housing for receiving in frictional engagement said female housing activating member, and wherein said male housing activating means further comprises a receiving member for receiving in frictional engagement said male housing activating member.

8. The electrical connector of claim 7 wherein said female housing further comprises a removable seal peripherally mounted on said female housing receiving member for preventing the passage of moisture to the plurality of electrical sockets and the plurality of male electrical terminals when the electrical sockets and male electrical terminals are engaged.

9. The electrical connector of claim 7 wherein said female housing receiving member comprises an annular shoulder integrally formed within said female housing, a face circumscribing an orifice for receiving in sliding engagement said female housing activating member spine, and wherein said male housing receiving member comprises an annular shoulder integrally formed within said male housing for receiving in sliding engagement said male housing activating member.

10. The electrical connector of claim 9 wherein said female housing activating means first and second engaging means each further comprise at least one pair of opposing tabs extending from the spine of said female housing activating member for engaging the ring of said female housing receiving member orifice, and wherein said male housing activating means first and second engaging means each further comprise at least one pair of tabs extending from the interior of the at least one side of said male housing activating member for engaging the annular shoulder of said male housing receiving member.

11. An electrical connector for connecting a plurality of collared electrical sockets to a plurality of collared male connecting terminals comprising:

a male housing having first and second ends for maintaining in spaced relationship the plurality of male connecting terminals;

a locking mechanism integrally formed within said male housing and having a plurality of prongs for cooperating with the collars of the plurality of male connecting terminals to prevent removal of the male connecting terminals from said male housing, said locking mechanism further comprising a receiving member concentrically surrounding said plurality of prongs;

at least one tubular conduit extending substantially throughout said male housing and integrally formed therewith:

a female housing having first and second ends for maintaining in spaced relationship the plurality of electrical sockets;

a locking mechanism integrally formed within said female housing and having a plurality of prongs for cooperating with the collars of the plurality of electrical sockets to prevent removal of the electrical sockets from said female housing, said locking mechanism further comprising a receiving member concentrically surrounding said plurality of prongs; and a plurality of tubular conduits extending substantially throughout said female housing and integrally formed therewith.

12. The electrical connector of claim 11 further comprising male housing activating means for press fit engagement with said male housing locking mechanism receiving member and having a face with at least one hole therethrough for maintaining in spaced relationship the plurality of male electrical terminals, and female housing activating means for press fit engagement with said female housing locking mechanism receiving member and having face with at least one hole therethrough for maintaining in spaced relationship the plurality of electrical sockets.

13. The electrical connector of claim 11 wherein the first end of said male housing is of sufficient dimension to snugly slidingly engage the first end of said female housing.

14. The connector of claim 13 wherein said male housing further comprises a latching shoulder integrally formed therewith and wherein said female housing further comprises a latch integrally formed therewith for cooperating with said latching shoulder to hold in releasable engagement of said male housing and said female housing.

15. The electrical connector of claim 14 further comprising a moisture excluding seal for peripheral mounting upon said female housing receiving member.

* * * * *

UNITED STATES PATENT AND TRADEMARK OFFICE

CERTIFICATE OF CORRECTION

PATENT NO. : 4,826,452

DATED : May 2, 1989

INVENTOR(S) : Sucha S. Sian et al.

It is certified that error appears in the above identified patent and that said Letters Patent is hereby corrected as shown below:

Column 4, line 42, "widge-shaped" should read --wedge-shaped--.

Column 5, line 11, "ring" should read --rim--.

Column 6, line 21, "having face" should read --having a face--.

Signed and Sealed this

Sixth Day of August, 1991

*Attest:*

*Attesting Officer*

HARRY F. MANBECK, JR.

*Commissioner of Patents and Trademarks*